US006065230A

United States Patent [19]

James

[11] Patent Number: 6,065,230

[45] Date of Patent: May 23, 2000

[54] SHOE HAVING CUSHIONING MEANS LOCALIZED IN HIGH IMPACT ZONES

[75] Inventor: Brent James, Manhattan Beach, Calif.

[73] Assignee: Brocks Sports, Inc., Bothell, Wash.

[21] Appl. No.: 09/151,881

[22] Filed: Sep. 11, 1998

Related U.S. Application Data

[63] Continuation of application No. 08/686,871, Jul. 26, 1996, abandoned, which is a continuation of application No. 08/357,912, Dec. 15, 1994, abandoned.

[51] Int. Cl.[7] ..... A43B 13/00

[52] U.S. Cl. ..... 36/25 R; 36/30 R; 36/32 R

[58] Field of Search ..... 36/28, 29, 30 R, 36/32 R, 25 R

[56] References Cited

U.S. PATENT DOCUMENTS

| | | | |
|---|---|---|---|
| D. 347,934 | 6/1994 | Mitsui et al. | D2/953 |
| D. 347,936 | 6/1994 | Takaoka | D2/960 |
| D. 347,938 | 6/1994 | Smith | D2/970 |
| D. 348,145 | 6/1994 | Nakano | D2/954 |
| D. 348,146 | 6/1994 | Nakano | D2/957 |
| D. 348,150 | 6/1994 | Lucas | D2/977 |
| 4,130,947 | 12/1978 | Denu | 36/30 R |
| 4,309,831 | 1/1982 | Pritt | 36/3 B |
| 4,309,832 | 1/1982 | Hunt | 36/32 R |
| 4,364,188 | 12/1982 | Turner et al. | 36/31 |
| 4,418,483 | 12/1983 | Fujita et al. | 36/28 |
| 4,638,577 | 1/1987 | Riggs | 36/114 |
| 4,658,514 | 4/1987 | Shin | 36/30 R |
| 4,676,010 | 6/1987 | Cheskin | 36/32 R |
| 4,694,591 | 9/1987 | Banich et al. | 36/102 |
| 4,798,010 | 1/1989 | Sugiyama | 36/30 R |
| 4,922,631 | 5/1990 | Anderié | 36/102 |
| 4,934,072 | 6/1990 | Fredericksen et al. | 36/29 |
| 4,972,613 | 11/1990 | Loveder | 36/105 |
| 5,052,130 | 10/1991 | Barry et al. | 36/107 |
| 5,097,607 | 3/1992 | Fredericksen | 36/291 |
| 5,191,727 | 3/1993 | Barry et al. | 36/107 |
| 5,212,878 | 5/1993 | Burke et al. | 36/27 |
| 5,317,819 | 6/1994 | Ellis, III | 36/25 R |
| 5,319,866 | 6/1994 | Foley et al. | 36/91 |
| 5,381,607 | 1/1995 | Sussmann | 36/28 |
| 5,384,973 | 1/1995 | Lyden | 36/25 R |
| 5,425,184 | 6/1995 | Lyden et al. | 36/29 |
| 5,598,645 | 2/1997 | Kaiser | 36/29 |
| 5,784,808 | 7/1998 | Hockerson | 36/102 |

FOREIGN PATENT DOCUMENTS

4018518 A1 1/1991 Germany .

OTHER PUBLICATIONS

Katz, Donald, Beaverton II, Just Do It, pp. 127–130.
Product Comparison Literature.

*Primary Examiner*—Paul T. Sewell
*Assistant Examiner*—J. Mohandesi
*Attorney, Agent, or Firm*—Perkins Coie LLP

[57] ABSTRACT

A shoe having improved sole component composed of a closed cell foam mid-sole which is adhered to at least a portion of the shoe's upper component. The mid-sole component has multiple thickened zones which are separated by multiple flex grooves between the zones. The thickened zones are provided in a fore foot and rear foot portions and underlie only the high impact regions of a wearer's foot during a wearer's gait cycle. An outer sole is attached to the outer bottom surface of the thickened zones of the mid-sole with the thickened zones being between the out sole and a portion of the upper component.

13 Claims, 2 Drawing Sheets

SHOE HAVING CUSHIONING MEANS LOCALIZED IN HIGH IMPACT ZONES

CROSS-REFERENCE TO RELATED APPLICATION

This application is a continuation of U.S. patent application Ser. No. 08/686,871, filed Jul. 26, 1996, now abandoned, which is a continuation of U.S. patent application Ser. No. 08/357,912, Dec. 15, 1994, abandoned.

FIELD OF THE INVENTION

The present invention relates to shoes and components thereof, and more particularly to a shoe having a sole with enhanced cushioning at high impact zones and having controlled flexibility.

BACKGROUND OF THE INVENTION

During sustained activity, an individual's feet are subjected to large, repetitious, ground reaction or impact forces generated in a gait cycle. The ground reaction forces associated with foot strike while walking are typically between one and one-and-one-half an athlete's body weight. Runners impact the ground with vertical forces as high as three to four times their body weight, depending upon their speed. In more dynamic activities, such as aerobics and basketball, impact forces as high as five to six times an athlete's body weight have been recorded.

The human body attenuates ground reaction forces through a complex 3-dimensional motion of the foot at the subtalar, metatarsal, and other joint areas. However, such natural biomechanics often cannot attenuate or dissipate impact forces sufficiently to prevent injury. Breakdown in the joints often results from insufficient attenuation or dissipation of ground reaction forces at the regions upon which the impact is focused. Those areas are concentrated in the heel strike and metatarsal regions of the foot.

Many components and materials which provide cushioning that attenuates and dissipates ground reaction forces are known. Prior art shoes have long incorporated a mid-sole composed of ethylvinylacetate ("EVA"), a closed cell foam material. EVA is a lightweight and stable foam that possesses viscous and elastic qualities. In addition, the density or durometer of EVA can be altered by adjusting the manufacturing technique.

Unfortunately, closed cell foam cushioning materials add stiffness to a shoe. As the thickness of the cushioning material is increased, the shoe loses the flexibility which is required to accommodate a natural running or walking gait cycle, and the shoe becomes uncomfortable for the wearer. Injury can sometimes result. Also, the desirable flexibility properties of a shoe will vary with its intended use. Shoes intended to be used on hard smooth surfaces (such as paved roads) may require flexibility both along the long or longitudinal axis of the shoe, as well as along the transverse that axis. Flexibility perpendicular to the long axis of the shoe can be undesirable in some shoes, such as off-pad or trail shoes.

Thus, there is a need for a lightweight shoe with enhanced cushioning properties and which has appropriate flexibility properties.

SUMMARY OF THE INVENTION

The present invention provides a shoe having an improved sole component composed of a closed cell foam mid-sole which is adhered to at least a portion of the shoe's upper component, the mid-sole component having multiple thickened zones which are separated by multiple flex grooves between the zones. The thickened zones underly principally only portions of a wearer's foot where ground reaction forces are focused during the wearer's gait cycle.

The thickened zones and grooves are positioned so as to biochemically correspond with the wearer's foot and thereby providing a combination of cushioning, flexibility and control/support which is appropriate for the activity and/or relevant surface.

The closed cell foam of the sole preferably is EVA.

The shoe of the present invention may further incorporate an out-sole adhered to the mid-sole and shaped so as to correspond to the thickened zones and flex grooves of the mid-sole. The present shoe may further include an interfacing material located between the mid-sole and the out-sole. The interfacing material can constitute a polymer, and preferably constitutes rubber.

In one embodiment of the present invention, the interfacing material is thinner in the flex grooves than on the outer plane (i.e., the wearing surface) of the thickened zones.

The sole component may have one or more such thickened zones in the forefoot region and one or more thickened zones in the heel region thereof, the thickened zones being separated by one or more flex grooves aligned more proximately to the longitudinal axis than the transverse axis of the sole component and one or more flex grooves aligned more proximately to the transverse axis than the longitudinal axis. The sole component can also have at least one thickened zone for underlying a wearer's metatarsal head.

DETAILED DESCRIPTION OF THE INVENTION

Figure 1:
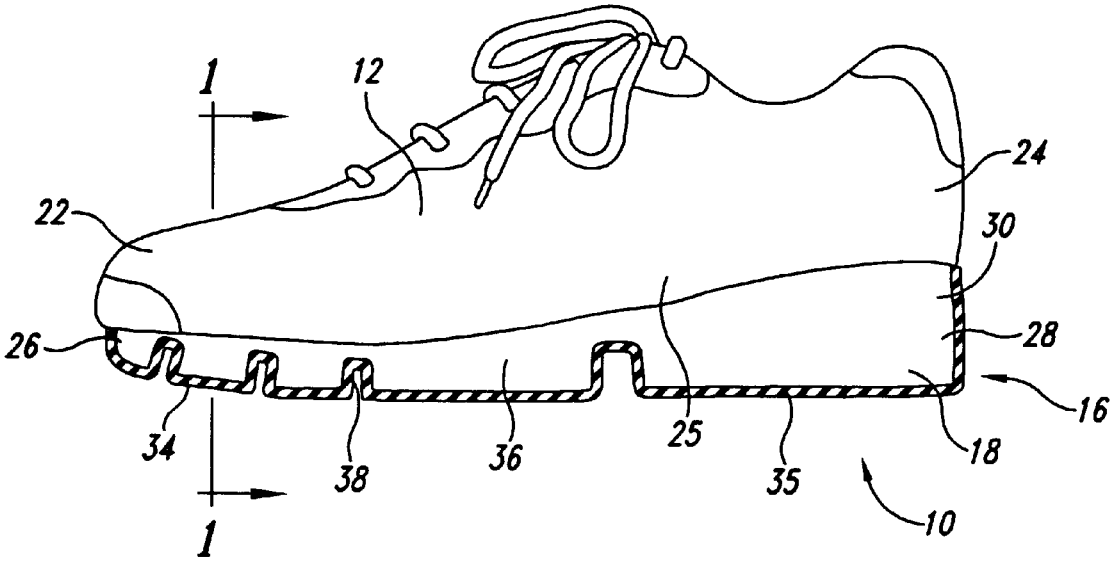
FIG. 1 is a schematic representation of a shoe with protrusions in the sole in accordance with a preferred embodiment of the present invention.
Figure 2:
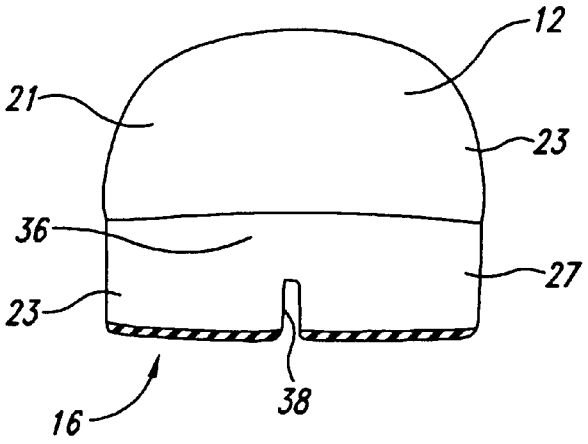
FIG. 2 is a cross-sectional view of the shoe of FIG. 1 taken along lines 1—1.
Figure 3:
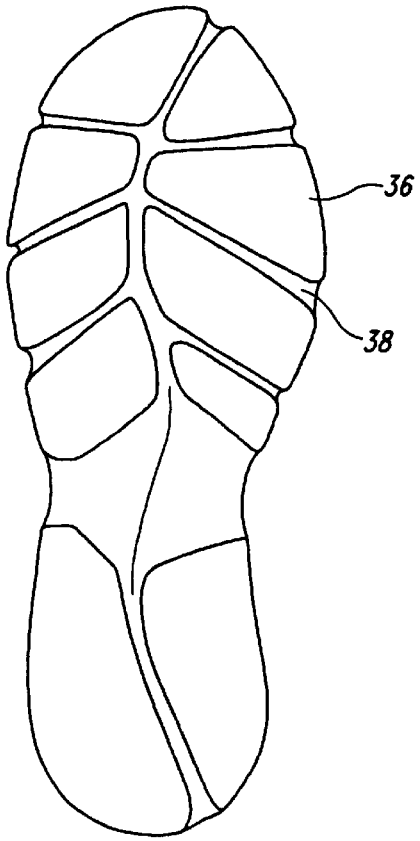
FIG. 3 is a bottom perspective view of the shoe of FIG. 1.

As shown in FIGS. 1 to 3, a shoe 10 including, for example, an athletic shoe, has an upper component 12 shaped and sized to receive a wearer's foot and is constructed such that it has a toe area 22 at its front end, a heel area 24 at its rear end, an inner or medial side 21, and an outer or lateral side 23. Sole 16 similarly has a toe end 26, a heel end 28, a medial side 25, and a lateral side 27. The sole 16 runs the length of the shoe between the toe and heel areas 22 and 24 respectively and between the medial and lateral sides 21 and 23 respectively of the upper shoe portion 12. Thus, the heel end 28 of the sole 16 communicates with the heel area 24 of the upper shoe component 12, the toe end, 26 communicates with the toe area 22 of the upper shoe component, and the sole's medial and lateral sides 25 and 27 communicate with the medial and lateral sides 21 and 23 of the upper shoe portion, respectively.

The sole 16 includes the mid-sole 18 which runs the length of the sole from the heel end 28 to the toe end 26, and receives the upper shoe component 12 along the top of the mid-sole. In the preferred embodiment illustrated herein, the top of the mid-sole's heel end 28 is shaped to form an integral heel cup 30 that receives the heel area 24 of the upper shoe portion 12 and provides enhanced lateral support for the wearer's foot. The mid-sole 18 is constructed of a flexible, lightweight, and durable material, such as blown EVA foam, so the mid-sole will flex in concert with the wearer's foot without excessive resistance. An out-sole 34 attaches to the bottom surface 35 of the mid-sole 18 in a conventional manner such that tread on the out-sole engages the ground or any other surface that the wearer may encounter.

The bottom surface of mid-sole 18 is comprised of thickened zones 36 which underly the portions of a wearer's foot upon which the strongest ground reaction forces are focused during a gait cycle. In particular, zones 36 underly the heel strike and metatarsal head areas where impact forces are particularly strong and where injury is most likely caused, particularly in the absence of sufficient cushioning. Zones 36 are separated by flex grooves 38 which are aligned to maximize foot flexibility while providing maximum mid-sole thickness and thereby maximizing cushioning or attenuation and dissipation of ground reaction forces. In the forefoot region, zones 36 are typically 14–18 mm thick, although thicknesses of 8–22 mm may be employed. In the heel region, thicknesses of 26–32 mm are typical, but may range from 16–36 mm. All of these thicknesses include an out-sole layer which is typically no more than 4 mm in the forefoot or 6 mm in the heel region.

Figure 4:
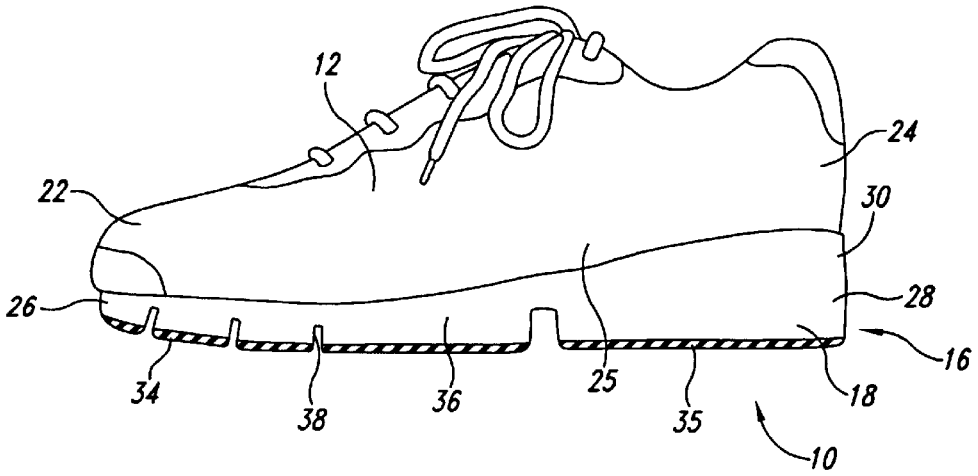
FIG. 4 is a schematic representation of an alternate embodiment of the present invention with the out-sole localized to the thickened zones.

In one embodiment of the present invention, the out-sole 26 is thinner in the area adjacent flex grooves 38 than in the area adjacent to the bottom surface of thickened areas 36. As best seen in FIG. 4, an alternate embodiment of the invention has an out-sole 34 that is localized on the outer bottom surface 35 of the thickened zones 36.

As will be readily appreciated, the configuration of the flex grooves and the spacing of the thickened zones can be varied to achieve desired flexibility properties. Grooves along the long axis tend to increase flexibility perpendicular to that axis. Transverse grooves increase flexibility along the long axis. Deeper or wider spaced grooves increase flexibility.

Due to the undulating surface which lacks a smooth plane, it is ineffective to use processes wherein buffing or abrading of the bottom surface of mid-sole 18 precedes adhering mid-sole 18 to out-sole 26. However, known methods well known by persons skilled in the art are utilized to make the shoe of the present invention in which utilization of acid etching techniques enables firm fixture or adherence of mid-sole to out-sole without buffing the surface. Such processing utilizing solvent waste and UV light removes silicate residue and oils on the mid-sole.

A shoe constructed in accordance with this invention can have EVA cushioning of about 16 mm in the thickened zone. Thicknesses of 20 mm or more are readily achievable. On the other hand, where less cushioning is required, the EVA layer may be as thin as 3 or 4 mm. This is in contrast to conventional shoes which cannot incorporate EVA layers of more than about 10 mm without unacceptable stiffness or weight. Thus, by localizing the cushioning material in areas where ground reaction forces are highest and by using flex grooves in the thickened zones, a lightweight shoe having exceptional cushioning properties and good flexibility is achieved. The segmented mid-sole/out-sole is a series of thickened zones that are synergistically tuned and thus react to the surface and the wearer's foot.

I claim:

1. A shoe for a foot of a wearer, the foot having high impact regions subjectable to impact forces during a gait cycle of the wearer, comprising:

a. an upper component shaped and sized to receive the foot of the wearer;

b. a mid-sole component having a forefoot portion, an arch portion, and a rearfoot portion adhered to at least a portion of the upper component, the mid-sole component having multiple enlarged thickened zones in the forefoot and rearfoot portions, the thickened zones in each of the forefoot and rearfoot portions being separated by flex grooves extending between the thickened zones, at least one flex groove being a substantially non-linear groove extending longitudinally along the forefoot portion, the thickened zones underlying only the high impact regions of the wearer's foot during the wearer's gait cycle; and c. an out-sole attached to an outer, bottom surface of the thickened zones of the mid-sole with the thickened zones being between the out-sole and a portion of the upper component, the out-sole being localized to only the outer, bottom surface of the thickened zones.

2. The shoe of claim 1, wherein the mid-sole is a closed cell foam.

3. The shoe of claim 1, wherein the out-sole is adhered to the mid-sole and shaped so as to correspond only to the thickened zones of the mid-sole.

4. The shoe of claim 1, wherein the out-sole comprises a polymer.

5. The shoe of claim 1, wherein the out-sole comprises rubber.

6. The shoe of claim 1, wherein the mid-sole component comprises a plurality of thickened zones in the forefoot portion and a plurality of thickened zones in the rearfoot portion thereof, the thickened zones being of such a thickness and orientation as to provide a desired degree of cushioning in the mid-sole component underlying the high impact regions of the wearer's foot.

7. A sole component for a shoe adapted to receive a foot of a wearer, the foot having high impact regions subjectable to impact forces during a gait cycle of the wearer, comprising a mid-sole component having multiple thickened zones which are separated by multiple flex grooves extending between the thickened zones, the thickened zones underlying only the high impact regions of the wearer's foot during the wearer's gait cycle, the mid-sole component having a longitudinal axis and a transverse axis, at least one of the flex grooves being generally non-linear and aligned more proximately to the longitudinal axis than the transverse axis, and another one of the flex grooves being aligned more proximately to the transverse axis than the longitudinal axis, and an out-sole being adhered to an outer bottom surface of the mid-sole component and shaped so as to correspond to only the thickened zones of the mid-sole component.

8. The sole component of claim 7, wherein the out-sole comprises a polymer.

9. The sole component of claim 7, wherein the out-sole comprises rubber.

10. The sole component of claim 7, wherein the mid-sole component includes a plurality of the thickened zones in a forefoot region of the mid-sole component and a plurality of the thickened zones in a heel region thereof, the thickened zones being separated by the flex grooves, the thickened zones being of such a thickness and orientation as to provide a desired degree of cushioning during the wearer's gait cycle.

11. The sole component of claim 10, wherein the wearer's foot has a metatarsal head, and the mid-sole component further comprises at least one thickened zone for underlying the wearer's metatarsal head.

12. The sole component of claim 10, wherein the thickened zones in the forefoot region ranges between about 14 mm and about 18 mm in thickness and the thickened zones in the heel region range between about 26 to 32 mm in thickness.

13. A shoe for a foot of a wearer, the foot having high impact regions subjectable to impact forces during a gait cycle of the wearer, comprising:

a. an upper component shaped and sized to receive the foot of the wearer;

b. a mid-sole component having a forefoot portion, an arch portion, and a rearfoot portion adhered to at least a portion of the upper component, the mid-sole component having multiple enlarged thickened zones in the forefoot portion, the thickened zones in the forefoot portion being separated by flex grooves extending between the thickened zones, at least one flex groove being a substantially non-linear flex groove extending longitudinally along the forefoot portion, the thickened zones underlying only the high impact regions of the wearer's foot in the forefoot portion during the wearer's gait cycle; and c. an out-sole attached to an outer, bottom surface of the thickened zones of the mid-sole with the thickened zones being between the out-sole and a portion of the upper component, the out-sole being localized to only the outer, bottom surface of the thickened zones.

* * * * *

UNITED STATES PATENT AND TRADEMARK OFFICE

CERTIFICATE OF CORRECTION

PATENT NO. : 6,065,230
DATED : May 23, 2000
INVENTOR(S) : Brent James

It is certified that error appears in the above-identified patent and that said Letters Patent is hereby corrected as shown below:

Section [73],
Replace "Brocks" with -- Brooks --.

Section [63],
Replace "Dec. 15, 1994" with -- June 10, 1994 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*